United States Patent [19]

Nayler et al.

[11] 4,014,454

[45] Mar. 29, 1977

[54] FLOATING ROOFS FOR LIQUID STORAGE TANKS

[75] Inventors: Irene Mary Nayler, Dudley; Michael Stalker, Manchester, both of England

[73] Assignees: Greengate Industrial Polymers Limited, Salford; Nayler Limited, Dudley, both of England

[22] Filed: Oct. 28, 1975

[21] Appl. No.: 626,537

[52] U.S. Cl. ..... 220/225; 220/226

[51] Int. Cl.[2] ..... B65D 87/20

[58] Field of Search ..... 220/216–227

[56] References Cited

UNITED STATES PATENTS

| | | | |
|---|---|---|---|
| 2,914,212 | 11/1959 | Fino | 220/222 |
| 2,968,420 | 1/1961 | Harris et al. | 220/225 |
| 3,014,613 | 12/1961 | Anderson, Sr. | 220/225 |
| 3,059,806 | 10/1962 | Joor | 220/225 |
| 3,075,668 | 1/1963 | Reese | 220/226 |
| 3,119,511 | 1/1964 | Giannini | 220/226 |
| 3,136,444 | 6/1964 | Moyer | 220/226 |
| 3,926,332 | 12/1975 | Okamoto | 220/226 |

FOREIGN PATENTS OR APPLICATIONS

| | | | |
|---|---|---|---|
| 28,746 | 1971 | Japan | 220/226 |

*Primary Examiner*—William Price
*Assistant Examiner*—Stephen Marcus
*Attorney, Agent, or Firm*—Norris & Bateman

[57] ABSTRACT

The invention comprises a liquid storage tank having a floating roof of the type in which the roof rises and falls with changes in the level of the liquid and a seal provided between the edge of the roof and the inner wall of the tank to prevent contamination or evaporation of the liquid and to allow for any out of truth of the tank and any lateral movement of the roof having the seal supported between a side wall of the roof and the tank wall in the form of a continuous annular bag of rubber or plastics coated fabric comprising inner and outer chambers the inner chamber lying in contact with the side wall of the floating roof and containing a liquid and the outer chamber lying in contact with the tank wall and containing a pre-shaped pad of a synthetic foam material, the whole being supported from the roof by bolts which pass through the top edge of the seal bag.

3 Claims, 2 Drawing Figures

FLOATING ROOFS FOR LIQUID STORAGE TANKS

This invention relates to improvements in tanks having floating roofs for liquid storage of the type in which the roof rises and falls with changes in the level of the liquid and a seal is provided between the edge of the roof and the inner wall of the tank to prevent contamination or evaporation of the liquid and to allow for any out of truth of the tank and any lateral movement of the roof.

Floating roofs are known which have an edge seal comprising an annular closed non-metalic bag of imperforate pliable material containing Kerosene or ether non-freezing material interposed between the periphery of the roof and the tank wall, the bag being suspended on a chain slung obliquely so that a weighted bag bearing against the main bag holds the main bag against the tank wall.

Other known seals have a block of resilient foam material inside the bag instead of a liquid.

The advantage of a liquid filled bag lies in the fact that the liquid exerts a constant pressure through the walls of the bg against both the side of the floating roof and the inner wall of the tank. A major disadvantage of the liquid filled bag is however, that the liquid is substantially incompressible and there is no cushioning effect on lateral movement of the roof except by displacement of the liquid. The foam filled bag has the advantage of providing such a cushioning effect, but the foam tends to suffer permanent deformation in use as a result of the compressive forces acting on it and consequently the foam filled bag will not exert a constant pressure between the roof and the tank wall during the whole of its working life.

The object of the present invention is to provide a floating roof for a liquid storage tank having a seal which combines the advantages of the liquid filled and foam filled types and is easily manufactured and installed in the tank.

According to the invention a liquid storage tank having a floating roof is provided with a seal supported between a side wall of the roof and the tank wall is the form of a continuous annular bag of rubber or plastic coated fabric comprising inner and outer chambers, the inner chamber lying in contact with the side wall of the floating roof and containing a liquid and the outer chamber lying in contact with the tank wall and containing a pre-shaped pad of synthetic foam material, the whole being suported from the roof by bolts which pass through the top edge of the seal bag.

The invention will be described with reference to the accompanying drawings.

Figure 1:
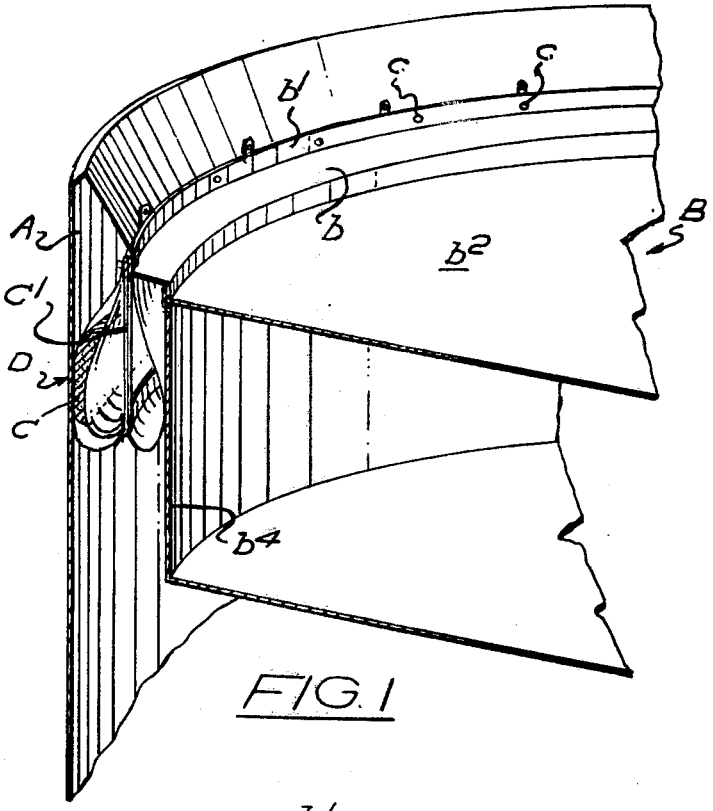
FIG. 1 is a vertical section through part of a storage tank of floating roof.
Figure 2:
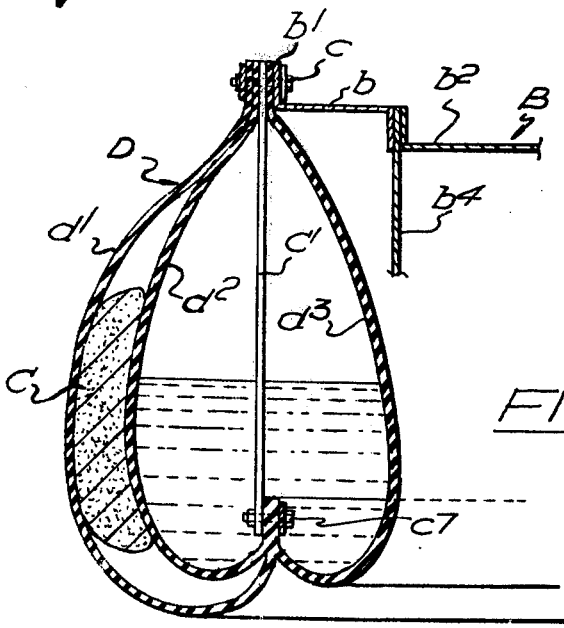
FIG. 2 is a vertical section through the rim of the roof and the seal to a larger scale.

A liquid storage tank A is provided with a floating roof B having a peripheral flange $b$ bent upwards to form a rim $b^1$. The upper deck $b^2$ is connected to a lower deck $b^3$ by a vertical side wall $b^4$.

A seal D is inserted between the side of the tank A and the side wall $b^4$ of the roof.

The seal is pre-formed into a tube-like bag composed of three sheets of rubber or plastic coated fabric $d^3$, $d^2$, $d^3$, united along one edge, the sheets being laid one on top of the other with a layer of powdered chalk or similar material or a separating layer of textile fabric between them except for a width (of say 2 or 3 inches) along one edge, so that the unseparated edges of the sheets will fuse together during vulcanization and form a solid edge portion. Two of the sheets $d^1$, $d^2$, are then folded back upon themselves on one side of the solid edge portion so formed and the third sheet $d^3$ is folded back similarly on the other side of the edge portion.

The edges of each sheet normal to the solid edge portion are overlapped and vulcanised in contact with each other so that they become permanently bonded to each other, thereby forming a continuous ring-shaped member.

A pre-shaped pad of synthetic foam material C in the form of a continuous ring is inserted between the first two sheets $d^1$, $d^2$ whilst the space between the third sheet $d^3$ and the inner edge of the sheet $d^2$ is filled substantially wholly or partially with a suitable liquid, such as for example Kerosene.

The free edges of the sheets $d^1$, $d^2$, $d^3$ are drilled at regular intervals with holes for example for the passage of bolts $c$ during insertion into the tank which fix the seal D to the rim $b^1$ of the floating roof B.

Bars $C^1$ are inserted inside the liquid containing compartment of the seal D at intervals and preassembled before the seal is applied to the tank. The lower ends of the bars $C^1$ are affixed to the solid rubber edge portion of the sheets $d^1$, $d^2$, $d^3$, by bolts $c$ and the upper ends of the bars $C^1$ are affixed to the free edges of the seal D and to the rim $b^1$ of the roof by the bolts $c$ during installation and can be fixed and replaced from the top of the tank roof.

A roof seal as hereinbefore described combines the advantages of the liquid and form filled seals. The hydrostatic pressure of the liquid compensates for any compression set of the foam and the foam ensures intimate contact with the tank wall. Furthermore the outer bag protects the liquid containing bag against damage from any protrusions on the tank wall whilst the liquid containing bag allows for lateral movement between the tank side and the side wall of the roof.

What I claim is:

1. A liquid storage tank having a floating roof adapted to rise and fall with changes in level of the liquid in the tank, said tank and roof having coextensive radially spaced side walls, and a seal mounted on the roof to depend between said side walls, said seal being an annular bag having flexible inner and outer sides in contact with the respective side walls and a flexible internal wall separating the bag into radially inner and outer annular chambers, fastening means securing the top of said bag to the roof and allowing the bag to be suspended therefrom between said side walls with its outer flexible side in sliding contact with the tank side wall, an annular body of liquid in the inner chamber and an annular pad of synthetic foam within said outer chamber.

2. A liquid storage tank as defined in claim 1, including a plurality of bars extending downwardly within the seal at intervals, each bar being secured at its upper end to the roof and at its lower end to the bottom of said bag.

3. A liquid storage tank as defined in claim 1 wherein said bag comprises three annular sheets of rubber or plastic coated fabric secured together around their upper and lower edges, with the upper edge attached to the roof by said fastening means.

* * * * *

UNITED STATES PATENT OFFICE

CERTIFICATE OF CORRECTION

Patent No. 4,014,454 Dated March 29, 1977

Inventor(s) Michael Stalker et al

It is certified that error appears in the above-identified patent and that said Letters Patent are hereby corrected as shown below:

The Assignees of the above-identified patent should read:

--Greengate Industrial Polymers Limited and Nayler (Petro Seals) Limited--

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*